US007433618B2

(12) United States Patent
Bartley et al.

(10) Patent No.: US 7,433,618 B2
(45) Date of Patent: Oct. 7, 2008

(54) SYSTEM AND METHODS FOR ENABLING GEOGRAPHICALLY SPECIFIC FUSER CONTROL PROCESS

(76) Inventors: Brian Keith Bartley, 201 Brown Dr., Burgin, KY (US) 40310; John Paul Brown, 612 Republic Ct., Lexington, KY (US) 40509; Kevin Dean Schoedinger, 3248 Mantilla Dr., Lexington, KY (US) 40513; Johnny Ray Sears, 431 Quail Run Rd., Versailles, KY (US) 40383

( * ) Notice: Subject to any disclaimer, the term of this patent is extended or adjusted under 35 U.S.C. 154(b) by 3 days.

(21) Appl. No.: 11/243,004

(22) Filed: Oct. 4, 2005

(65) Prior Publication Data

US 2007/0077082 A1 Apr. 5, 2007

(51) Int. Cl.
*G03G 15/20* (2006.01)

(52) U.S. Cl. ..... 399/67

(58) Field of Classification Search ..... 399/67, 399/90

See application file for complete search history.

(56) References Cited

U.S. PATENT DOCUMENTS 4,371,259 A * 2/1983 Howitt ..... 355/38
5,436,712 A 7/1995 Wayman et al.
5,811,764 A 9/1998 Hirst
6,160,975 A 12/2000 Bartley et al.
6,229,120 B1 5/2001 Jewell
6,359,266 B2 3/2002 Little et al.
6,608,977 B2 8/2003 Tamaoki
6,804,478 B2 10/2004 Martin et al.
2003/0230934 A1* 12/2003 Cordelli et al. ..... 307/43

FOREIGN PATENT DOCUMENTS

JP 10024641 A * 1/1998

* cited by examiner

*Primary Examiner*—Quana M Grainger

(57) ABSTRACT

An image forming system (210) includes an engine controller (60) and memory device (152) with a power supply (162) supporting a 220 volt, 120 volt or 100 volt level. A fuser control capability indicator (164) is read by the engine controller (60) in order to determine the fuse control capabilities supported by the power supply (162) and, in conjunction, with a geographic region indicator of the system (210), a determination is made as to the appropriate fuser control process to adopt based on the geographic region in which the system (210) is used.

31 Claims, 4 Drawing Sheets

SYSTEM AND METHODS FOR ENABLING GEOGRAPHICALLY SPECIFIC FUSER CONTROL PROCESS

TECHNICAL FIELD

The invention relates generally to controlling a fuser within an image forming system such as a laser printer. More particularly, the invention relates to methods of controlling the time a printer takes to print a first sheet from a stand-by or power conserving state. Still more particularly, the invention relates to controlling the type of fuser control mode to be implemented, either phase control or integer half cycle, for example, based on the geographic region in which the image forming system is to be used.

BACKGROUND OF THE INVENTION

Inkjet and laser printers have become commonplace and necessary computing peripherals in most workplace and home computing environments. Today, many printers are multi-functional sophisticated image forming devices capable of printing images on a large array of recording media such as letterhead, paper envelopes and a host of other media. Over the years, printer performance has improved greatly in terms of resolution, number of pages printed per minute, document feeding options, copying capabilities and other qualifiers of a printer's performance. One particular indicator of a printer's performance that is becoming an important selling point is the time to first copy, which is an indicator of how long it takes to print a first sheet from a stand-by or power conserving state.

In an electrophotographic (EP) printer, unfused toner particles are electrostatically attracted to the media to form an image. In order for the image to be fixed permanently the media must be fused. A fuser combines high temperature and pressure to the toner until it is melted and forced to adhere to the media. As such, the fuser is a critical component in the overall image forming process of most EP image forming devices.

The time to print the first sheet can be reduced by maintaining the instant-on fuser temperature at a "ready" temperature while not printing. This temperature is just warm enough to prevent the fuser from being the primary delay in the time to first copy. Otherwise, if the fuser is off there is typically delay, perhaps as much as two seconds, for the fuser to warm up for a particular print job.

A problem that can arise from maintaining a printer in this type of "ready mode" is the amount of visible light flicker that results while the fuser is being kept warm. Applying energy to a fuser heating element, be it a lamp or ceramic heater, draws enough current to cause a flicker affect on incandescent or fluorescent lighting coupled to the same electrical circuit as the printer. This can be particularly annoying since the flicker occurs while the printer is in ready mode and yet the printer is perceived by the user to be idle.

The amount of flicker can be considerably reduced by controlling the fuser with a phase control method. This method of fuser control conducts current across a variable portion of each AC waveform half cycle, thus reducing the amount of in-rush current to the fuser assembly. The problem with phase control is that it tends to cause difficulty in passing Electro Magnetic Control ("EMC") harmonics specifications.

At the same time, the specifications on flicker and EMC harmonics levels vary across different geographies. In Europe and other regions that use 220 volt line voltage, the amount of in-rush current is not as great as that on 120 volt devices. As such, a printer operating in a 220 volt region will most likely meet the flicker requirements without having to use phase control. Instead, the engine can use integer half cycle control, which has no problems in meeting the EMC harmonics requirements.

However, in the U.S. and other geographies that use a 120-volt power supply, the current draw of the heater is higher and causes annoying light flicker when using integer half cycle control. Although there is no specification for flicker in these regions, the issue is addressed for customer satisfaction purposes by using the phase control method. EMC harmonics specifications are met by adding filtering components (i.e. an inductor choke, for example) to the low volt power supply.

Likewise, Japanese models exhibit flicker when integer half cycle control is used with its 100-volt power supply. However, when using phase control, the printer can not meet the industry harmonics standards for that region even with the modifications to the low volt power supply. Therefore, integer half cycle must be used even though it results in flicker. Although there is no flicker standard in Japan, it can prove to be an annoyance to the customer, especially while the printer is not printing and is keeping the fuser warm in ready mode. To eliminate this, the fuser ready mode control needs to be disabled such that the fuser turns off immediately after a warm up condition or upon completion of a print job. Because ready mode is disabled on this model, it will not have optimal first copy time, but this is an accepted compromise to eliminate flicker while not printing.

Since the specifications vary across different geographies as to the limits on flicker and EMC harmonics levels, a need exists for a means of determining what type of fuser control should be used based on the geographic location of a printer. At the same time, such a means would have to consider whether to enable or disable the fuser ready mode.

BRIEF DESCRIPTIONS OF THE DRAWINGS

The accompanying drawings incorporated in and forming a part of the specification illustrate several aspects of the present invention and together with the description and claims serve to explain the principles of the invention. In the drawings:

References in the detailed description below refer to like references in the figures, unless otherwise indicated.

DETAILED DESCRIPTION

For simplicity the discussion below will use the terms "media", "sheet" and/or "paper" to refer to a discrete unit of recording media. It should be understood, however, that this term is not limited to paper sheets, and any form of discrete recording media is intended to be encompassed therein, including without limitation, envelopes, transparencies, postcards, labels, special media and the like.

Figure 1:
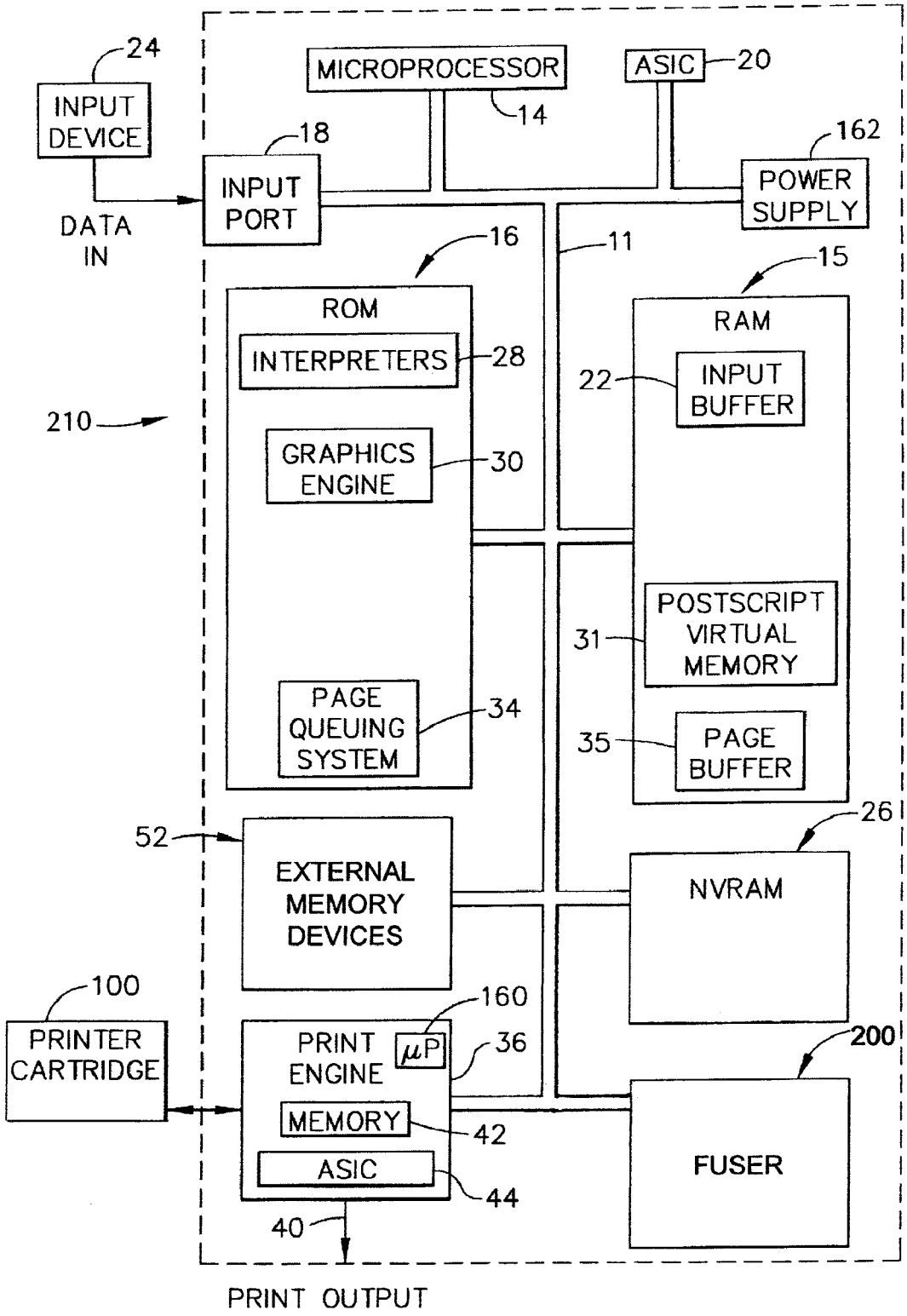
FIG. 1 is a block diagram of the major components of an image forming system according to the principles of the present invention.

Referring to the drawings, FIG. 1 shows a generalized block diagram of an image forming system in the form of a laser printer, denoted generally by reference numeral 210. In particular, system 210 (the terms "laser printer" and "system" shall be used interchangeably throughout) is constructed to support the functionality of the present invention as described herein. It should be understood, however, the present invention may be implemented or have application in other image forming system configurations, such as an ink jet printer, dye diffusion or other known printing platform.

System 210 will preferably contain certain relatively standard components, such as a power supply 162 which may have multiple outputs of different voltage levels, a microprocessor 14 having address data lines, and control and/or interrupt lines, Read Only Memory (ROM) 16 and Random Access Memory (RAM) 15, which is divided by software operations into several portions for performing several different functions. Furthermore, an NVRAM memory at 26 is typically provided in such systems. In addition, an external memory device designated by the reference numeral 52 may be an option on many if not most laser printers, in which a hard disk drive and/or a Flash memory device can be added to the base printer upon the request of the user/customer. Such alternative storage memory devices may also be present in top-line ink jet printers.

System 210 also contains at least one input port, or in many cases several types of input ports, as designated by the reference numeral 18. Each of these ports would be connected to a corresponding input buffer, generally designated by the reference numeral 22 on FIG. 1. Each port 18 would typically be connected (a) to an output port of either a personal computer (PC) or a workstation (WS) (designated on FIG. 1 as an "input device" 24) that would contain a software program such as a word processor or a graphics package or computer aided drawing package, or (b) to a network that could be accessed by such a PC or WS. System 210 may also contain an Application Specific Integrated Circuit (ASIC) 20, which typically contains a large number of logic circuits.

For completeness, the operational aspects of the system 210 will be described in general form. Once text or graphical data has been received by input buffer 22, it is commonly communicated to one or more interpreters designated by the reference numeral 28. A common interpreter is PostScript.™., which is an industry standard used by many laser printers. To speed up the process of rasterization, a font pool and typically also a font cache may be stored in memory within most laser printers. Such font pools and caches supply bitmap patterns for common characters so that a graphics engine 30 can easily translate each such character into a bitmap using a minimal elapsed time.

Once the data has been rasterized, the data may be directed by a page queuing system 34 into a page buffer 35, which may comprise a portion of RAM designated by reference numeral 15. In a typical laser printer, an entire page of rasterized data may be temporarily stored by the page queuing system 34 in the page buffer 35, although some of the more modern laser printers do not buffer an entire page's worth of data at one time, thereby managing to operate with a much smaller amount of RAM in a "partial page buffer." The data within the page buffer 35 may be communicated in real time to a print engine designated by the reference numeral 36. Print engine 36 typically includes a laser light source (not shown), and its output 40 is the physical printing onto a piece of paper, which is the final print output from system 210. Print engine 36 also may contain a programmable non-volatile memory device 42, in addition to registers contained within its ASIC 44 that may act as either RAM or ROM, as desired. Programmable memory device 42 could consist of a Flash type-device, or an NVRAM-type device, for example, or any other type of non-volatile memory device.

Still referring to FIG. 1, it will be understood that the address, data, and control lines are typically grouped in buses, which are electrically conductive pathways that are physically communicated in parallel (sometimes also multiplexed) around the various electronic components within system 210. For example, the address and data buses may be sent to all ROM and RAM integrated circuits, and the control lines or interrupt lines directed to all input or output integrated circuits that act as buffers. For ease of illustrating the present invention, the various buses used within system 210 are grouped on FIG. 1 into a single bus pathway, designated by the reference numeral 11.

A portion of the RAM 15 is typically allocated for virtual memory for at least one interpreter, and on FIG. 1 a POSTSCRIPT virtual memory is depicted at the reference numeral 31. This virtual memory 31 can be used, for example, for storing PostScript font descriptors within the printer. In addition, particularly important information that is to be retained in system 210 while unpowered may be stored in a quickly accessible non-volatile memory location called "NVRAM," which is designated by the reference numeral 26. This non-volatile RAM is most likely (using today's technology) an EEPROM integrated circuit chip.

The print cartridge, generally designated by the reference numeral 100, is used in typical printing devices available at the present time. For laser printers (or other types of electrophotographic printing devices), reference numeral 100 represents a replaceable EP print cartridge that contains toner material, as well as a photoconductive drum unit 132 (not shown) supplied in most such EP print cartridges. The EP print cartridge typically contains black toner material for monochrome laser printers or at least three different toner materials for color laser printers (for the standard "process" colors of cyan, magenta, and yellow—and possibly black), although multi-color EP printers and copiers are also available that use multiple individual toner cartridges that each contain only a single color of toner material. Whether or not a black toner cartridge—or a black toner "bay" of a multi-color EP print cartridge—is included for the particular printer or copier is a matter of design choice.

System 210 also includes a fuser 200 which is used in an electrophotographic machine, such as system 210, to fuse previously applied toner particles onto a surface of a print medium, such as paper. Typically, the fuser 200 includes a fuser roll (not shown) which presses the toner into the print medium. Also, the fuser roll is typically heated internally by a heating element (not shown), such as a fuser lamp or ceramic heater, disposed therein. The use, operation and implementation of a fuser, including the fuser roll and heating element, are well known.

Of course, certain printer-specific information as well the process logic for the print engine 36 may be stored within the programmable memory device 42. For example, according to the present invention, programmable memory device 42 may be used to store identification information that identifies the kind of operator panel (not shown in FIG. 1 ) coupled to the system 210. As is well known, an operator panel typically includes the various menu/function keys by which a user interfaces directly with the system 210 and by which the user is prompted with various menu options, operator and error messages. As such, an operator panel is most likely specific to the geographic region in which the printer, such as system 210, is utilized so that a panel in an English speaking region of the world will present English characters while one in Japan will utilize Japanese characters. Thus, and as explained in more detail below, an identification string may be stored in memory device 42 to indicate the type of operator panel installed in the system 210. The fact that identification information is stored by the system 210 permits the selection of one or more fuser control processes according to the present invention.

ASIC 44 may store printer logic to cause print engine 36 to retrieve the information stored in a printer's memory, such as programmable memory device 42, in order to support a fuser control function according to the invention. Such printer logic may also be provided within memory device 42 and retrieved by ASIC 44 upon power up of the system 210 or in some other memory space, such as the Raster Image Processor (RIP)

firmware (see reference 152 in FIG. 2 ), for example, in order to support methods of determining a fuser control process based on geographic region according to the invention. Of course, other ways of implementing this functionality may be devised as will be apparent to those of ordinary skill in the art.

It may be useful to be able to update some of the stored information contained in this memory device 42. One way of implementing a fuser control function may involve dedicating a portion of the memory device 42 to store control parameters about the type of fuser control method to be used in the system 210. For example, it may be desirable to store the ready mode state (enable/disable) and type of fuser control to apply to fuser 200 as parameters for use every time the fuser completes a print job.

Figure 2:
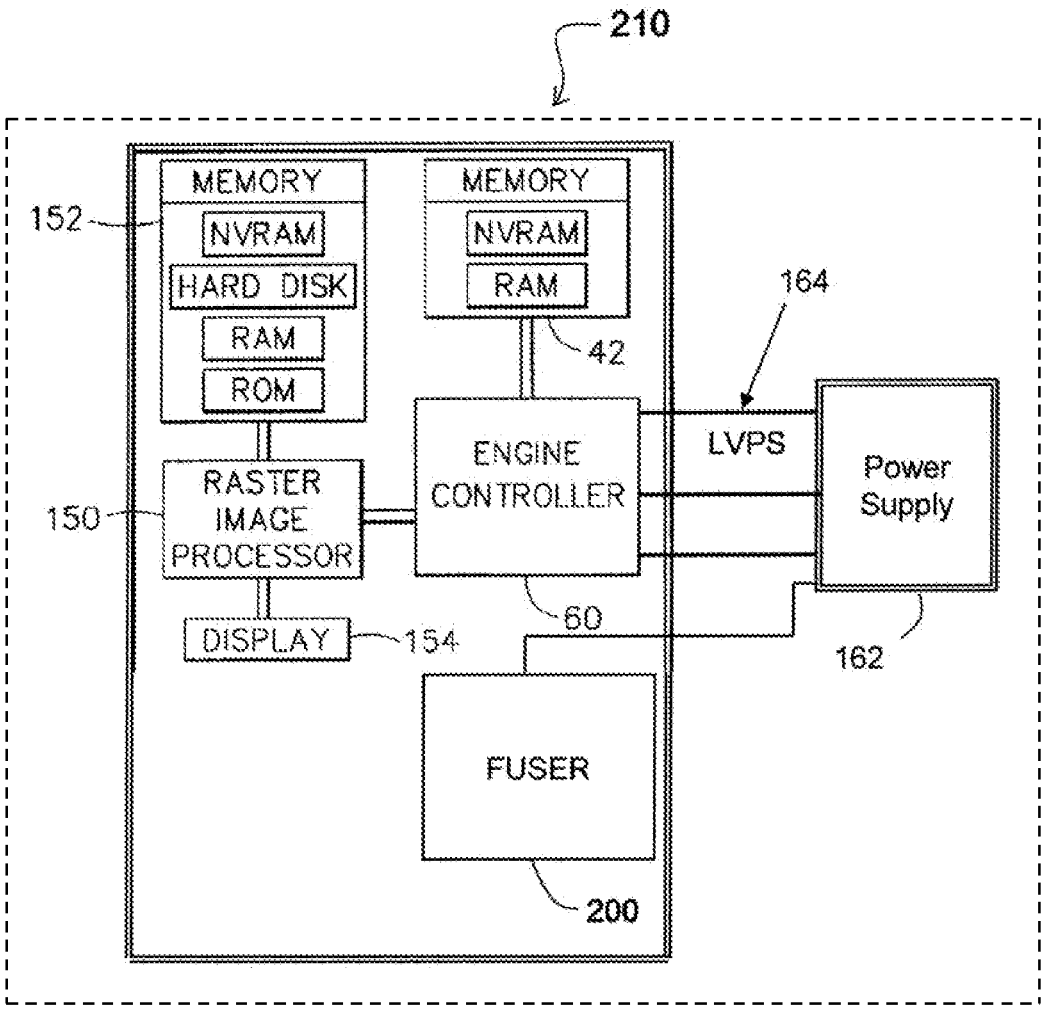
FIG. 2 is a block diagram illustrating a basic hardware configuration for image forming system according to one embodiment of the invention.

FIG. 2 is a block diagram illustrating a basic hardware configuration for image forming system, denoted generally as 210, supporting geographic specific fuser control according to one embodiment of the invention. In particular, system 210 is shown to include a raster image processor (RIP) 150 in communication with an engine controller 160. The raster image processor 150 may include a microprocessor to perform certain functions such as the rasterizing function performed by the graphics engine 30 (see FIG. 1). Raster image processor 150 will be referred to herein as the "RIP" 150, and it interfaces via electrical buses to memory devices, such as depicted on FIG. 2 by the reference numeral 152. As can be seen on FIG. 2, the memory device 152 includes (but is not limited to) RAM, ROM, and NVRAM, which roughly correspond to the RAM 15, ROM 16, as well as the NVRAM 26 on FIG. 1.

The RIP 150 also is in communication with operator panel 154, which may comprise a liquid crystal display that can show alphanumeric characters, as are commonly seen on laser printers. The RIP 150, using its programming located in the ROM and data located in its RAM and NVRAM, will control the information depicted on the panel 154, and will also control the data flow to and from the engine controller 160. In order for RIP 150 to communicate with operator panel 154, it may retrieve and utilize identification information about the operator panel 154 from memory device 42 and/or 152, as appropriate, which would inform the RIP 150 of the type of operator panel which has been installed on the printer, such as system 210, on which the operator panel 154 is attached. This same function may be accomplished by engine controller 60 or any other suitable logic device of the image forming system 210.

As should be clear, the engine controller 160 may be part of the print engine 36 (see FIG. 1) and, if so, may be configured to communicate with its own set of RAM and NVRAM, designated by reference numeral 42 (see FIG. 1). Thus, it is possible to obtain identification information about the operator panel 154 from other memory structures of the image forming system platform. Likewise, it is possible for the NVRAM and RAM memory devices 42 to comprise physical integrated circuits that are also used in part as the NVRAM and RAM 152 used by the RIP 150. Engine controller 160 may also take the form of a microprocessor or microcontroller, and may well be resident within ASIC 44 (see FIG. 1).

As shown, a power supply 162 is operably coupled to the image forming system 210 to provide a source of energy for operating the various internal electrical and/or electromechanical devices of the system 210. Typically, power supply 162 takes the form of an alternating current (AC) signal having a characteristics frequency and voltage amplitude. The signal may be rectified and converted to direct current (DC) within the system 210. Typically, however, the signal provided by power supply 162 depends on the specific geographic region in which the system is used so that, for example, the United States and other geographic regions provide a standard of 120 volts while most European countries support a 220 volt standard. Still other geographic regions of the world, such as Japan, support a 100 volt standard. Thus, power supply 162 should conform to the standard of the region in which the system 210 will be used.

Since power to the fuser 200 and other components of the image forming system 210 is provided by power supply 162, an identification pin 164 may be provided as an indicator of the fuser control capabilities supported by the power supply 162. For example, pin 164 may present a signal level that can be correlated by the RIP 150 or engine controller 60 to a specific fuser control process according to the geographic region in which the system 210 is used. Thus, a low volt power supply (LVPS) signal on pin 164 may be used by engine controller 60 to determine what type of fuser control process to use. In one embodiment, pin 164 indicates the type of opto-isolator used in the power supply which is an indicator of the fuser control process, either phase control or integer half cycle, which the power supply 162 supports.

Thus, the signal on identification pin 164 (LVPS signal) is correlated to an appropriate fuser control method, either a phase control or integer half cycle, to be used by the image forming system 210 which, in turn, is related to the geographic region in which the system 210 is to be used. By accessing and reading the signal on pin 164, the engine controller 60 can determine what type of fuser control method to use. Geographic regions with the 120-volt power supply may require that phase control is to be used for maintaining fuser temperature, while others (Japan and 220-volt machines) may require that integer half cycle fuser control be used.

For the Japan printer model, once the LVPS signal on pin 164 indicates that it supports integer half cycle control, the engine controller 164 still needs to know if it is a Japanese model so it can disable the fuser ready mode. For this, and according to one embodiment, engine controller 164 may read configuration information stored in memory device 152 (or memory device 42) to determine whether the system 210 is being used in Japan (or other region where ready mode should be disabled) or not. For example, a "config ID" string may be initialized within the memory device 152 (or memory device 42) upon manufacture to indicate the type of operator panel 154 that has been installed. This information may be used by the RIP 150 for other reasons, but since the Japanese models has a unique operator panel, it can also be used to determine whether to enable or disable fuser ready mode.

In another embodiment, the information of the "config ID" parameter stored in memory device is not indicative of the operator panel 154 installed in the system 210. Rather, the "config ID" parameter indicates directly the geographic region in which the system 210 is to be used. If so, it may be unnecessary for engine controller 60 to access pin 164 since the geographic region information can be directly obtained from the memory device 152. Thus, the present invention contemplates several methods of determining the geographic specific fuser control process to use.

The matrix in table 1 below illustrates how power supplies for different geographic regions along with operator panel type information may be used by the engine controller 60 to decide on the control type to use and whether to enable fuser ready control.

TABLE 1

| Power Supply | Phase Control Supported | Japanese Op Panel | Fuser Control Type/Ready Mode Enabled |
|---|---|---|---|
| 220 V | No | No | Integer Half Cycle/Yes |
| 120 V | Yes | No | Phase Control/Yes |
| 100 V | No | Yes | Integer Half Cycle/No |

Figure 3A:
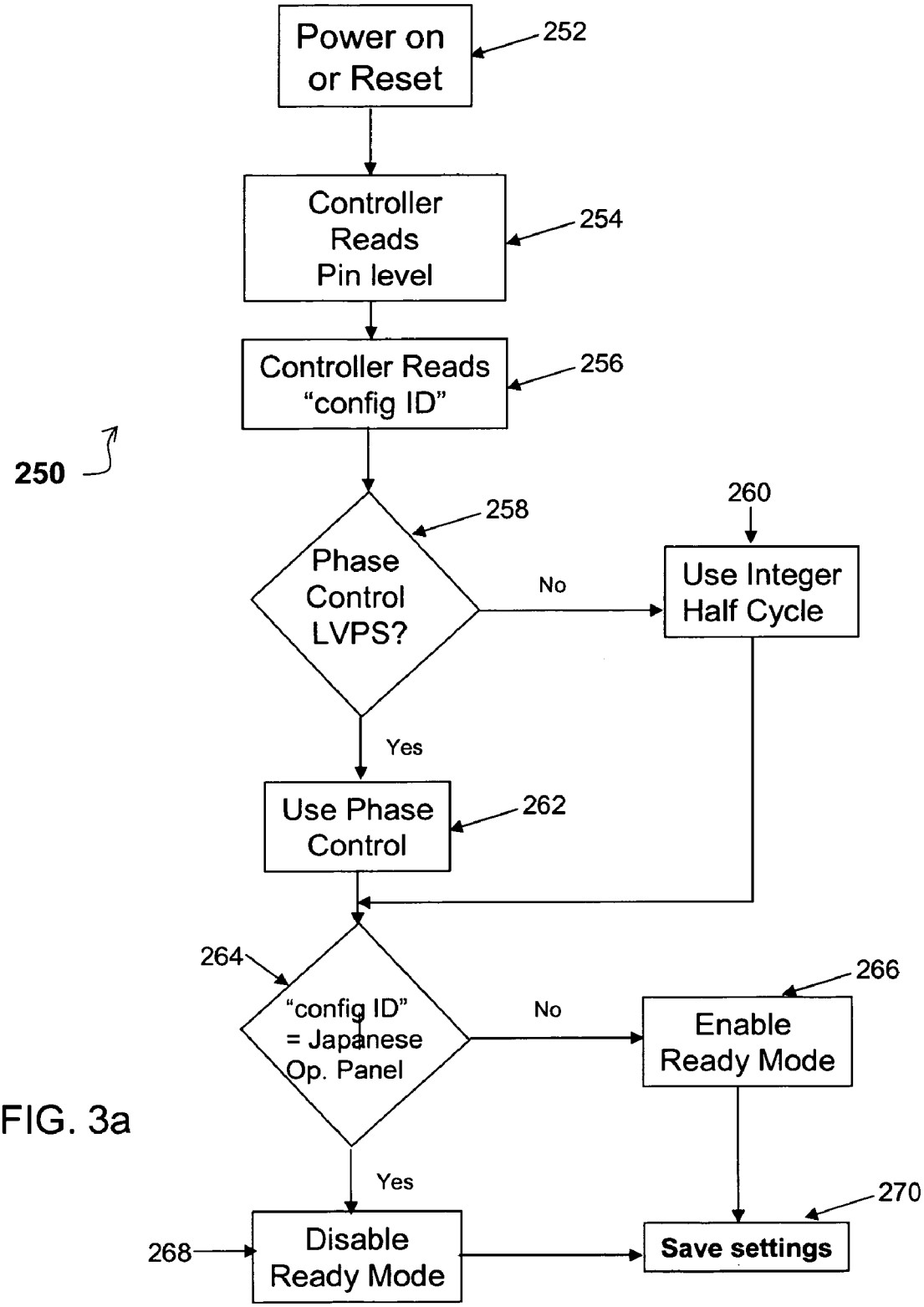
FIGS. 3*a* and 3*b* are process flow diagrams for methods of determining geographic specific fuser control for image forming system according to the invention.

With reference to FIG. 3*a*, therein is shown a process flow diagram, denoted generally as 250, for a method of determining geographic specific fuser control for an image forming system according to one embodiment of the invention. Method 250 begins at step 252 wherein an image forming system, such as system 210, is powered up or performs a power reset. Next, at step 254, the engine controller 60 accesses and reads a fuser control capability indicator, such as indicator pin 164, in order to determine the fuser control capabilities of a power supply to the system. For example, in FIG. 2, LVSP level may be read to indicate what the fuser control capabilities of the power supply 162. The engine controller 60 may then read the configuration identification "config ID" stored in memory device 152 (or 42), step 256, in order to determine the type of operator panel 154 attached to the image forming system 210.

The value of fuser control indicator is analyzed to determine if the power supply supports a phase control process of the fuser, step 258. If so, phase control is determined as the fuser control process, step 262. If not, process flow is directed to step 260 wherein the integer half cycle fuse control method is selected.

Next, at step 264, after the fuser control process to be used is determined, process flow is directed to step 264 wherein identification information ("config ID") used to identify the type of operator panel, such as operator panel 154, attached to the image forming system 210 is retrieved. If "config ID" indicates the operator panel is a Japanese model, process flow is directed to step 268 where ready mode for the image forming system is disabled. If "config ID" indicates the operator panel is not a Japanese model, the ready mode of the image forming system is enabled, step 266. Finally, after ready mode is enabled or disabled, at step 270 the settings may be saved for future use.

As indicated above, it is possible to employ alternate methods of determining the fuser control process to use based on the geographic region in which the image forming system is to be utilized. For example, in FIG. 3*b*, a process flow diagram denoted generally as 300, is shown for a method of determining geographic specific fuser control for an image forming system according to a second embodiment of the invention. The method of FIG. 3*b* may be employed in a situation where, for example, only two (2) types of power supplies are employed such as a 220-volt and a 110-volt power supplies. It has been found that it is possible to utilize a 110-volt power supply in regions supporting both a 110-volt system and a 100-volt system.

Figure 3B:
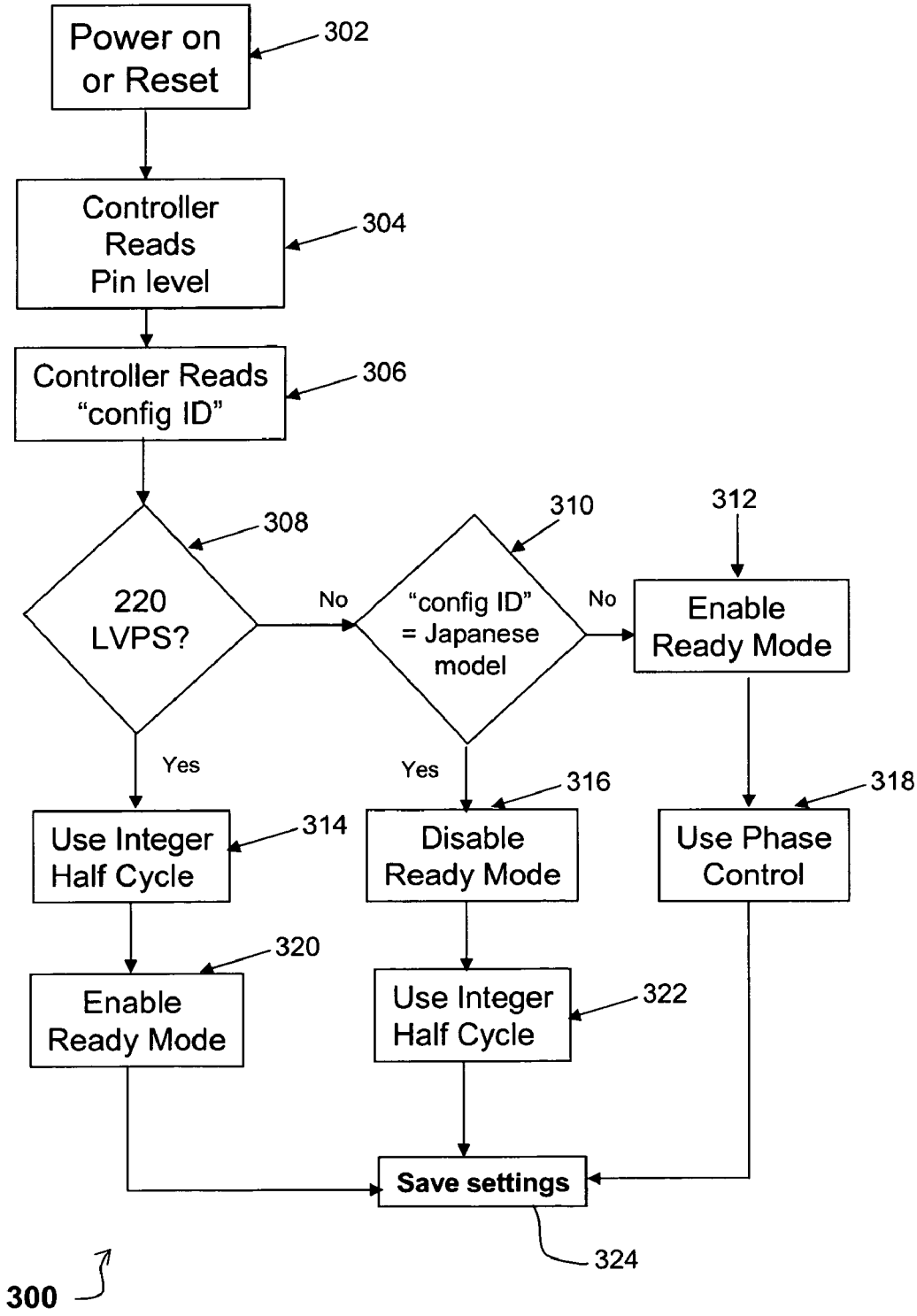

With reference to FIG. 3*b*, steps 302, 304, and 306 correspond to steps 252, 254, and 256 of FIG. 3*a*, respectively. At step 308, a determination is made if the power supply supports 220-volt operation. If so, integer half cycle is selected as the fuser control process, step 314.

However, if the power supply of the image forming system does not support 220-volt operation, at step 310, the "config ID" parameter is read to determine if the image forming system is a Japanese model. Thus, "config ID" is not directly related to the operator panel installed on the system but is an indicator of the type of image forming system and the region in which it is to be utilized. If the system is not a Japanese model, ready mode for the image forming system is enabled, step 312, and phase control is selected as the fuser control process, step 318. This allows the image forming system to maintain an instant-on fuser temperature at a "ready" temperature while not printing.

If, on the other hand, it is determined the image forming system is a Japanese model, ready mode is disable, step 316, and integer half cycle is selected as the fuser control process, step 322.

At this point, both the fuser control process to be used and the ready mode status of the system have been determined. As such, these settings can be saved, step 324, in a memory device of the image forming system for future use.

Of course, once the fuser control capabilities of the power supply of an image forming system, it is possible to set other parameters relating to the fuser control process of the system. For example, the ramping rate of the current provided to the fuser may be set according to a manufacturer's preference. Likewise, the fuser control algorithm utilized by the image forming system may include a variety of parameters which may be tuned or modified. Such parameters may include, for example, the gain or temperature set point among others as is well understood by those of ordinary skill.

It should be understood that modifications can be made to the invention in light of the above detailed description. The terms used in the following claims should not be construed to limit the invention to the specific embodiments disclosed in the specification and the claims. Rather, the scope of the invention is to be determined entirely by the following claims, which are to be construed in accordance with established doctrines of claim interpretation.

What is claimed is:

1. A method of determining geographic specific fuser control for image forming system, the method comprising the steps of:

determining the fuser control capabilities provided by an output from a power supply supplying power to the image forming system, said output comprising a fuser control indicator signal from said power supply corresponding to a fuser control process supported by said power supply;

reading a stored configuration identification parameter related to the geographic specifics of the image forming system;

from both the fuser control indicator signal and the stored configuration identification parameter, determining what type of fuser control process to use for the image forming system; and wherein said step of determining the fuser control capabilities further comprises the step of determining the voltage level of said power supply by reading said signal provided by said power supply.

2. The method of claim 1 wherein the step of determining the fuser control process to use involves determining whether to use phase control or integer half cycle control for controlling a fuser of the image forming system.

3. The method of claim 1 wherein the step of determining the fusing control process to use involves determining whether to enable or disable a ready mode of the image forming system.

4. The method of claim 1 wherein the step of determining the fuser control process involves setting the ramp rate of the fuser.

5. The method of claim 1 wherein the step of determining the fuser control process to use involves setting at least one parameter of an algorithm for controlling a fuser within the image forming system.

6. The method of claim 5 wherein said parameter is the temperature set point of said fuser.

7. The method of claim 1 further comprising the step of determining if the signal is characteristic of a 120-volt or 220-volt power supply.

8. The method of claim 7 further comprising the step of using a phase control for controlling the fuser if the signal is characteristic of a 120 volt power supply.

9. The method of claim 7 further comprising the step of using an integer half cycle control for controlling the fuser if the signal is characteristic of a 220 volt power supply.

10. The method of claim 1 wherein said reading step further comprises the step of accessing a memory location within a memory device of said image forming system to retrieve said configuration identification parameter.

11. The method of claim 10 wherein said identification parameter identifies the type of operator panel installed on the image forming system.

12. The method of claim 10 wherein said identification parameter identifies the geographic specificity of said image forming system.

13. The method of claim 11 further comprising the step of determining from the type of operator panel installed if the image forming system is a Japanese model.

14. The method of claim 13 further comprising the step of disabling a ready mode of the image forming system if the operator panel is a Japanese model.

15. For an image forming system having a fuser and a memory device for storing information about the image forming system, a method of determining geographic related fuser control, the method comprising the steps of:

reading a stored configuration identification parameter specifying a configuration of the image forming system;

determining the fuser control capabilities provided by an output from a power supply supplying power to the image forming system, said output comprising a fuser control indicator signal from said power supply corresponding to a fuser control process supported by said power supply;

using both the fuser control indicator signal and the stored configuration identification parameter, determining what type of fuser control process to use for controlling how power is applied to a fuser of the image forming system; and further comprising the step of disabling a fuser ready mode of the image forming system where the configuration identification parameter reflects that the image forming system is a Japanese model.

16. The method of claim 15 wherein the step of determining the fuser control process to use involves determining whether to use phase control or integer half cycle control for controlling the fuser of the image forming system.

17. The method of claim 15 wherein said reading and determining steps are performed when said image forming system is powering up.

18. The method of claim 15 further comprising the step of using a phase control process when the fuser control capabilities indicate a voltage of approximately 120 volts is being used by the image forming system.

19. The method of claim 15 further comprising the step of using an integer half cycle control process when the fuser control capabilities indicate a voltage of approximately 220 volts is being used by the image forming system.

20. The method of claim 15 further comprising the step of storing a set of control parameters in a memory device of said image forming system, the control parameters indicative of the type of fuser control process determined for use by said image forming system.

21. The method of claim 20 further comprising the step of checking the control parameters after the completion of any process that turns on the fuser within the image forming system.

22. The method of claim 21 further comprising the step of turning the fuser off if the control parameters indicate the ready mode of the image forming system has been disabled.

23. The method of claim 15 wherein the step of determining the fuser control process to use involves a step selected from the group consisting of: determining whether to use phase control or integer half cycle control for controlling the fuser, setting the ramp rate of the fuser, setting at least one parameter of an algorithm for controlling the fuser, and setting the temperature set point of said fuser.

24. An image forming system supporting geographic specific fuser control comprising:

a fuser for receiving media upon which toner from a print cartridge has been deposited;

a print engine adapted for controlling the power delivered to said fuser;

a power supply supplying power to the image forming system and having an interface operably coupled to said print engine, said interface providing a fuser control indicator from which the fuser control capabilities of said power supply can be determined; and process logic for causing said print engine to read fuser control indicator and determining the fuser control capabilities of said power supply, said process logic further configured to determine what type of fuser control process to use for controlling how power is applied to said fuser.

25. The system of claim 24 further comprising a geographic region indicator specifying in which geographic region the image forming system is to used.

26. The system of claim 25 wherein said process logic is further adapted to cause said print engine to access said geographic region indicator and to determine whether to enable/disable a fuser ready mode of said image forming system.

27. The image forming system of claim 26 wherein said process logic is further adapted to cause said print engine to adopt a specific fuser control process based on the value of said fuser control indicator and said geographic specific indicator.

28. The image forming system of claim 24 wherein said fuser control process is a phase control process if said fuser control indicator specifies the power level of said power supply is approximately 120 volts.

29. The image forming system of claim 24 wherein said fuser control process is phase control process if said fuser control indicator specifies the power level of said power supply is approximately 220 volts.

30. The image forming system of claim 26 wherein said process logic causes said print engine to turn off a ready mode of said image forming system if the value of said geographic specific indicator indicates the system is a Japanese model.

31. The image forming system of claim 26 further comprising a memory device for storing said geographic specific indicator.

* * * * *